US008037563B2

(12) United States Patent
Richards et al.

(10) Patent No.: US 8,037,563 B2
(45) Date of Patent: Oct. 18, 2011

(54) MULTIPLE AIR SOURCE MATTRESS CONTROL SYSTEM

(75) Inventors: Sandy M. Richards, Pershing, IN (US); Eric R. Meyer, Greensburg, IN (US); Christopher R. O'Keefe, Batesville, IN (US); Bradley T. Wilson, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 399 days.

(21) Appl. No.: 12/409,821

(22) Filed: Mar. 24, 2009

(65) Prior Publication Data

US 2010/0242170 A1 Sep. 30, 2010

(51) Int. Cl.
*A61G 7/057* (2006.01)
*A47C 27/10* (2006.01)

(52) U.S. Cl. ..... 5/713; 5/710; 5/715; 5/615

(58) Field of Classification Search ..... 5/615, 706–715
See application file for complete search history.

(56) References Cited

U.S. PATENT DOCUMENTS 4,711,275 A * 12/1987 Ford et al. ..... 141/95
4,852,195 A 8/1989 Schulman
5,020,176 A 6/1991 Dotson
5,509,155 A 4/1996 Zigarac et al.
5,687,438 A 11/1997 Biggie et al.
5,781,949 A * 7/1998 Weismiller et al. ..... 5/715
5,926,884 A 7/1999 Biggie et al.
5,963,997 A 10/1999 Hagopain
6,269,504 B1 8/2001 Romano et al.
6,353,950 B1 * 3/2002 Bartlett et al. ..... 5/617
6,584,628 B1 * 7/2003 Kummer et al. ..... 5/615
6,701,556 B2 3/2004 Ramano et al.
6,782,574 B2 * 8/2004 Totton et al. ..... 5/713
6,877,178 B2 4/2005 Chapman et al.
7,191,482 B2 * 3/2007 Romano et al. ..... 5/714
7,260,860 B2 * 8/2007 Chambers et al. ..... 5/713
7,409,735 B2 8/2008 Kramer
7,565,710 B2 * 7/2009 Chambers et al. ..... 5/715
7,712,171 B2 * 5/2010 Butler ..... 5/715
2002/0073489 A1 6/2002 Totton et al.
2006/0112489 A1 6/2006 Bobey et al.
2008/0263776 A1 * 10/2008 O'Reagan et al. ..... 5/714

* cited by examiner

*Primary Examiner* — Michael Trettel
(74) *Attorney, Agent, or Firm* — Barnes & Thornburg LLP

(57) ABSTRACT

A patient support apparatus, such as a mattress, has multiple air sources to inflate air bladders of the apparatus. In one embodiment, a first air source provides air to one or more main support bladders and a second air source provides air to one or more microclimate bladders when a control system of the patient support apparatus operates according to a first mode of operation. The first and second air sources provide air to a turn bladder when the control system operates according to a second mode of operation. In another embodiment, a first air source provides air to at least one main support bladder and to at least one microclimate bladders. A second air source is dedicated for inflating at least one turn bladder.

20 Claims, 3 Drawing Sheets

MULTIPLE AIR SOURCE MATTRESS CONTROL SYSTEM

BACKGROUND

The present disclosure relates to person support surfaces, such as air mattresses. More particularly, the present disclosure relates to control systems for person support surfaces.

Mattresses that turn or rotate a person by some amount from side to side are known. These mattresses are oftentimes found in healthcare facilities to support patients. Some of these mattresses have what is referred to as a turn assist function in which the patient is turned, on a one-time basis, toward their left side or toward their right side for a period of time and then returned back to a flat or supine position. Some mattresses have a lateral rotation function in which a patient is repeatedly turned from side to side in a cyclical manner once the lateral rotation function is started. This is sometimes referred to as lateral rotation therapy. The mattresses having one or both of these functions typically include a number of air bladders and an air source, such a pump, compressor, or blower, that inflates the bladders of the air mattress to achieve the various functions. Some mattresses have one set of bladders that is inflated to provide general support to the person and another set of bladders that is normally inflated, or normally deflated, depending upon the particular air mattress design, to provide the lateral rotation and/or turn assist function(s) of the mattress.

Mattresses that have microclimate control, such as a low air loss feature, are also known. Some mattresses with microclimate control or low air loss have a thin envelope or layer above the rest of the mattress components and air is circulated through this layer to pull moisture away from the person's skin. The circulating air is then expelled to ambient via passages or perforations at the sides, ends and/or underside of the layer. Other types of mattresses with a low air loss feature may have small perforations on the upper surface so that air is expelled directly toward the patient to cool the patient and/or to remove moisture from the patient via direct air impingement. In either of these types of low air loss mattresses some sort of an air source remains in an operating or "on" state to provide a generally constant stream of air to the low air loss layer. Low air loss mattresses comprised of a number of laterally extending individual air sacs that are thicker than a thin upper layer are also known and tend to be of the types that have perforations on or near their upper surfaces through which air is expelled directly toward the person supported by the mattress. Another type of low air loss mattress is one that includes a perforated hose or tube in the interior of a mattress coverlet but outside a set of person support bladders contained within the coverlet. Air is expelled from the perforated hose or tube within the interior of the coverlet, circulates through the coverlet to draw moisture from the patient through the coverlet, and then is expelled out of the interior of the coverlet through one or more passages, such as holes present between teeth of a plastic zipper, for example, or through discrete perforations provided in the coverlet.

SUMMARY

The present invention comprises an apparatus or system having one or more of the features recited in the appended claims and/or one or more of the following features, which alone or in any combination may comprise patentable subject matter:

A person support apparatus for supporting a person may have a set of air bladders that are inflatable to support the person. The set of air bladders may include a single air bladder or may include multiple air bladders. Thus, the set of air bladders may include a first air bladder and a second air bladder in some embodiments. The person support apparatus may also have at least one turn bladder that is inflatable to turn the person toward one of the person's sides. The turn bladder may be used for turn assist or continuous lateral rotation therapy or both.

The person support apparatus may include a control system which may have a first air source and a second air source. The control system may have a first mode of operation in which the first air source may provide air to the first air bladder and in which the second air source may provide air to the second air bladder. The control system also may have a second mode of operation in which the first and second air sources both may provide air to the at least one turn bladder.

In some embodiments, the second air bladder is situated above the first air bladder. The at least one turn bladder may be situated between the first air bladder and the second air bladder in some embodiments and may be situated beneath the first air bladder in other embodiments. In still other embodiments, the turn bladder may be situated beneath both the first and second bladders. The second air bladder may comprise a microclimate control bladder or a microclimate layer, such as a bladder or layer having a low air loss feature. In other embodiments, a microclimate device such as a low air loss layer or bladder, or a perforated tube, may be provided in addition to the first and second bladders.

The control system may have a first valve coupled to the first air source and a second valve coupled to the second air source. The first valve may have a first position in which air from the first air source is fed to the first air bladder and also may have a second position in which air from the first air source is fed to the at least one turn bladder. The second valve may have a third position in which air is fed from the second air source to the second air bladder and also may have a fourth position in which air from the second air source is fed to the at least one turn bladder.

According to this disclosure, the control system may further comprise a third valve and the at least one turn bladder may comprise a right turn bladder and a left turn bladder. The third valve may have a fifth position in which air received by the third valve from the first and second air sources is fed to the right turn bladder. The third valve may have a sixth position in which air received by the third valve from the first and second air sources is fed to the left turn bladder.

The first air bladder may comprise a plurality of air bladders. The second air bladder may comprise a plurality of air bladders. The plurality of first and/or second bladders may correspond to head, seat, thigh, and foot sections of the mattress, for example, in some embodiments. The first and second air sources may each comprise at least one of a pump, a compressor, or a blower. The first air source may be a different type of air source than the second air source. Thus, for example, the first air source may be a compressor and the second air source may be a blower. All permutations and combinations of these types of air sources are intended to be within the scope of this disclosure.

The left turn bladder and right turn bladder may be inflated to accomplish respective left and right turn assist functions. Thus, the control system may be operable to inflate a designated one of the left turn and right turn bladders to an inflated condition for a predetermined period of time, on a one-time basis, in response to a user activation of a turn assist feature of the control system. After the predetermined period of time has elapsed, the inflated left turn or right turn bladder, as the case may be, is deflated by the control system. In other embodiments, the left turn bladder and right turn bladders may normally both be inflated in which case, the control system may be operable to deflate the left turn bladder to accomplish a right turn assist function and the right turn bladder may be deflated to accomplish a left turn assist function.

The left turn bladder and the right turn bladder may be inflated and deflated alternately to accomplish a lateral rotation therapy function. Thus, the control system may be operable to repeatedly and alternately inflate and deflate the left turn and right turn bladders in response to a user activation of a continuous lateral rotation therapy feature of the control system. The turn bladders may be used as turn assist bladders and as rotation bladders in some embodiments. User inputs may provide input signals to the control system to indicate whether the turn bladders are to be controlled as turn assist bladders or as lateral rotation bladders by the control system.

According to this disclosure, in another embodiment, the control system may have a first valve that is moveable between a first position in which air from the first air source is fed to the first bladder and a second position in which air from the first air source is fed to the second bladder. In this embodiment, the second air source may be coupled to the at least one turn bladder. The second air source may have an off state in which the at least one turn bladder is deflated and may have an on state to inflate the at least one turn bladder. Thus, the first air source may dedicated to inflating the first and second bladders and the second air source may be dedicated to inflating the at least one turn bladder.

The at least one turn bladder may comprises a right turn bladder and a left turn bladder and wherein the control system comprises a second valve coupled to the second air source. The second valve may have a third position in which air is fed from the second air source to the right turn bladder when the second air source is in the on state and the second valve may also have a fourth position in which air from the second air source is fed to the left turn bladder when the second air source is in the on state.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
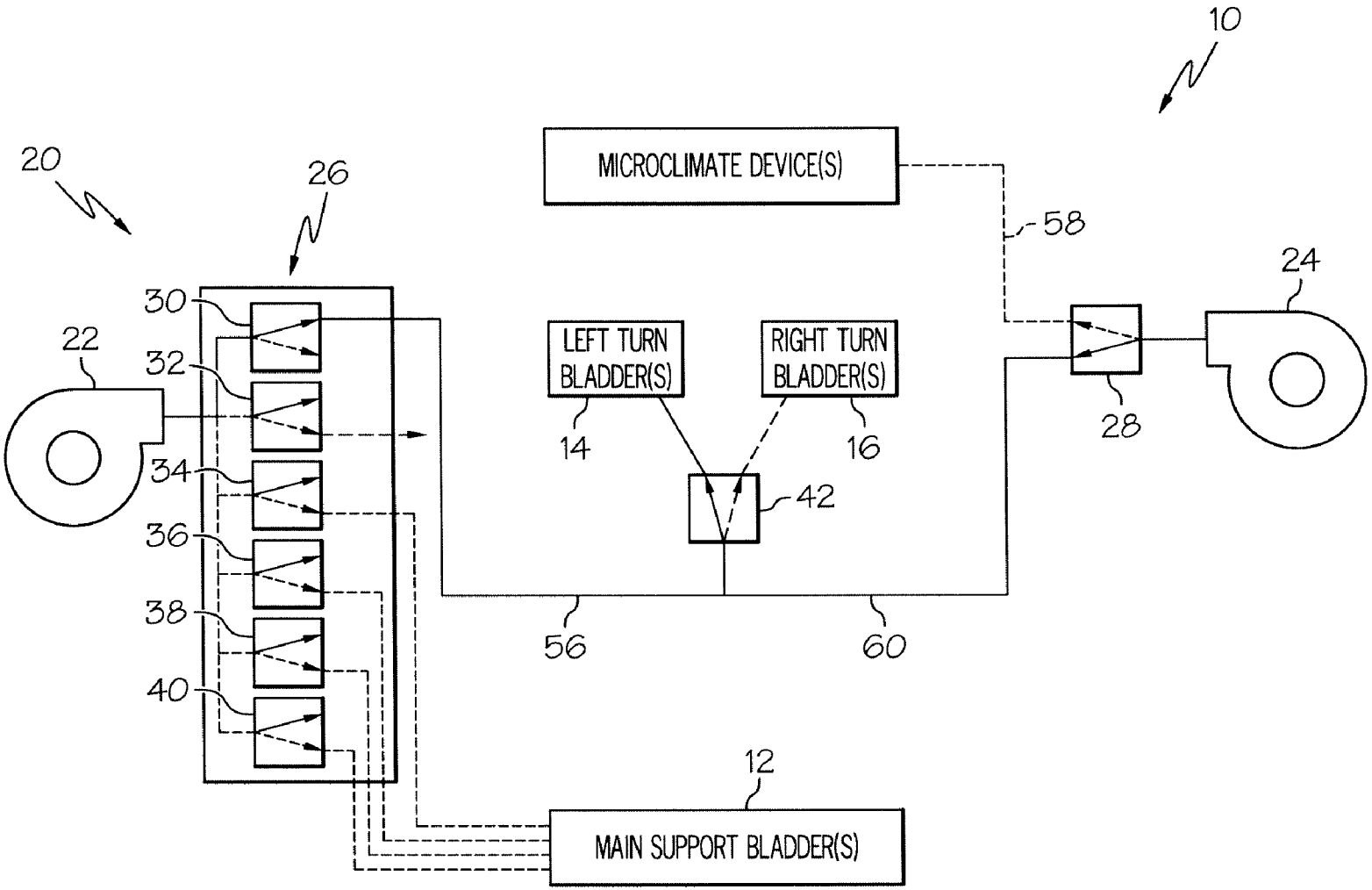
FIG. 1 is a block diagram of a first embodiment of a person support apparatus according to this disclosure, showing the person support apparatus having multiple air sources that are used to provide air to various air bladders of the patient support apparatus.

A patient support apparatus 10, such as an air mattress, according to this disclosure includes a set of main support bladders 12, a left turn bladder 14, a right turn bladder 16, and at least one microclimate device 18 as shown diagrammatically in FIG. 1. In some embodiments, the bladders 12, 14, 16, and the at least one microclimate device 18 are contained within an outer covering (not shown) which is sometimes referred to as a coverlet, casing, ticking or encasement as is well known in the art. Additional mattress elements, such as a fire barrier layer or sock, a foam base layer, foam side bolsters, and/or inflatable side bolsters may optionally be included as part of the mattress. These additional components typically will also be contained with the outer covering. The microclimate device 18 may be situated atop the covering and be coupled to the covering by a suitable fastener such as zipper, for example.

The set of main bladders 12 may include just a single bladder 12 in some embodiments. However, in other embodiments, there is a plurality of main bladders 12. The main bladders 12 may be grouped into zones such as, for example, a head zone including one or more bladders 12 that typically would be expected to support the head and upper torso region of a person resting on the mattress 10, a seat zone including one or more bladders 12 that typically would be expected to support the buttocks region of a person resting on the mattress 10, a thigh zone including one or more bladders 12 that typically would be expected to support the thighs of a person resting on the mattress 10, and foot zone including one or more bladders 12 that typically would be expected to provide support from the knee to the feet of a person resting on the mattress 10.

The microclimate device 18 comprises one or more microclimate control bladders in some embodiments. Such microclimate bladder(s) may be configured to provide a microclimate layer that is situated over a portion, or all, of main bladders 12. The microclimate layer may be just beneath the upper layer of the outer covering in some embodiments and may be situated above the upper layer of the outer covering in other embodiments. In some embodiments, the microclimate layer, may include one or more three dimensional fiber networks including crush resistant materials such as Spacenet® material or another type of material through which air may be forced. Spacenet® material is discussed in U.S. Pat. Nos. 7,480,953, 5,731,062 and 5,454,142 and each of these patents is hereby incorporated by reference herein in their entirety for all that they teach. The microclimate layer contemplated by this disclosure may be fashioned somewhat like an envelope or may simply include one or more sheets of material through which air can flow but that are not situated within any bladder or any within any envelope. In still other embodiments, microclimate device 18 includes one or more perforated tubes or hoses that are situated within an interior region of the mattress covering.

The patient support apparatus 10 includes a pneumatic control system 20 having a first air source 22 and a second air source 24 as shown diagrammatically in FIG. 1. The arrangement of the air sources 22, 24 as shown in FIG. 1 is not meant to indicate physical location but rather to convey diagrammatically the structure and operation described herein. It is contemplated that the first and second air sources 22, 24 be arranged together or separately and on any side of the patient support 10. Air sources 22, 24 may comprise a pump, a compressor, a blower, or any other similar device for pressurizing air. The pneumatic control system 20 further comprises a first valve arrangement 26 coupled to the first air source 22 including a first turn valve 30, a vent valve 32, and main support bladder valves 34, 36, 38, and 40. The pneumatic control system 20 also includes a second turn valve 28 coupled to the second air source 24. It is contemplated that the first valve arrangement may include the first turn valve 30, the vent valve 32, and as few or as many support bladder valves as correlates with the number of support bladders 12 incorporated into patient support 10. Additionally, pneumatic control system 20 includes a turn direction valve 42 coupled to first turn valve 30, second turn valve 28, and the turn bladders 14, 16.

Each of the valves in the first valve arrangement 26 moves between an open position, in which air is allowed to flow through the respective valve, and a closed position, in which air is not allowed to flow through the respective valve. The first turn valve 30 pneumatically couples the first air source 22 with the turn direction valve 42 via a conduit 56. The vent valve 32 pneumatically couples the first air source 22 with the atmosphere surrounding the patient support 10. The main support bladder valves 34, 36, 38, 40 pneumatically couple the first air source 22 with the main support bladder 12.

The second turn valve 28 moves between a first position, in which second air source 24 is pneumatically coupled to the microclimate device 18 via a conduit 58, and a second position, in which the second air source 24 is pneumatically coupled to the turn direction valve 42 via a conduit 60. The turn direction valve 42 moves between a first position, in which the valve pneumatically couples the first turn valve 30 and second turn valve 28 to the left turn bladder 14, and a second position, in which the valve pneumatically couples the first turn valve 30 and second turn valve 28 to the left turn bladder 16. The arrangement of the valves shown in FIG. 1 is not meant to indicate physical location. It is contemplated that all the valves may be included in a single bank, individually mounted, or arranged in a combination of banked and individually mounted valves.

Figure 3:
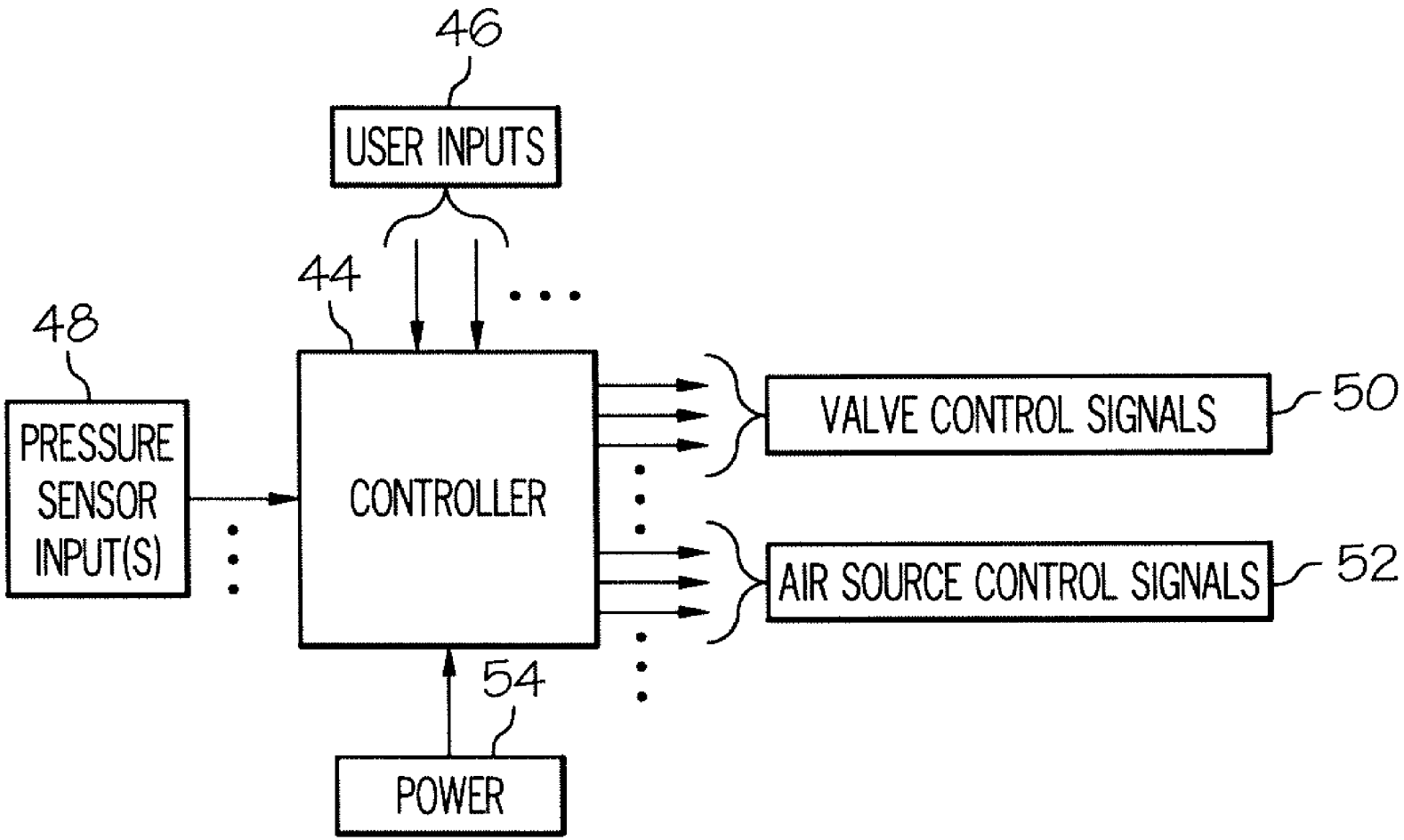
FIG. 3 is a block diagram of an electrical control system that is included in the first and second embodiments of the patient support apparatus.

The operation of the pneumatic control system 20 is governed by a controller 44 shown in FIG. 3. Controller 44 receives user inputs 46 and pressure sensor inputs 48. Controller 44 outputs valve control signals 50 and air source control signals 52. User inputs 46 to controller 44 may include desired pressures of support bladders 12, desired inflation of turn bladders 14, 16, desired engagement of microclimate device 18, or patient specific factors that may be used to calculate desired pressures or therapies. Pressure sensor inputs 48 may include pressures inside of support bladder 12, turn bladders 14, 16, or microclimate device 18. Pressure sensor inputs 48 may be provided by pressure sensors situated anywhere in the pneumatic control system 20 circuit, in any of the valves, in any of the bladders 12, 14, 16, or in the microclimate device 18. Valve control signals 50 determined by controller 44 move the valves in pneumatic control system 20 between respective open and closed or first and second positions. Air source control signals 52 determined by controller 44 turn the first air source 22 and second air source 24 on and off. Controller 44 receives energy from a power source 54. Power source 54 may be any one of or a combination of a wall socket, battery pack, generator, or any other suitable electrical energy source.

Operation of the pneumatic control system 20 by controller 44 includes three modes of control. In a first "standard support" mode, the controller 44 monitors and adjusts the support bladder 12 and may operate the microclimate device 18 therapy. The second "turn assist" mode effects the inflation of one of the turn bladders 14, 16. The third "return" mode deflates a previously inflated turn bladder 14, 16. The controller 44 may, based on user inputs 46 and pressure sensor inputs 48, engage in any of the three modes at any time during operation. For example, the second and third modes may be alternated inflating and deflating turn bladders 14, 16 in sequence to produce continuous lateral rotation therapy.

Controller 44 determines from user inputs 46 whether inflation or deflation of a turn bladder 14, 16 is desired. If no inflation or deflation of a turn bladder 14, 16 is desired, controller 44 operates in the first mode. In the first mode of operation, controller 44 periodically compares desired pressures of support bladder 12 with corresponding pressure sensor inputs. If the pressure sensor inputs 46 indicate that the pressure in the support bladder 12 is lower than desired, the controller 44 operates the pneumatic control system 20 to increase the support bladder 12 pressure. If the pressure sensor inputs 46 indicate that the pressure in the support bladder 12 is higher than desired, the controller 44 operates the pneumatic control system 20 to decrease the support bladder 12 pressure. If the pressure sensor inputs 46 indicate that the pressure in the support bladder is at a desirable level, the controller 44 operates the pneumatic control system 20 to maintain the support bladder 12 pressure. In addition, the controller 44 determines from user inputs 46 if microclimate modification is desired. If microclimate modification is desired, the controller 44 operates the pneumatic control system 20 to turn on the microclimate device 18.

If controller 44 determines that inflation of a turn bladder 14, 16 is desired, then controller 44 enters a second mode of operation. In the second mode of operation, the controller 44 turns on the first and second air sources 22, 24 and operates the pneumatic control system 20 valves in order to pneumatically couple the air sources 22, 24 to the desired turn bladder 14, 16. The controller 44 then compares the desired, fully-inflated, turn bladder 14, 16 pressure with the corresponding pressure sensor inputs 46. If the pressure sensor inputs 46 indicate that the pressure in the turn bladder 14, 16 is lower than desired, the controller 44 operates the pneumatic control system 20 to increase the turn bladder 14, 16 pressure. If the pressure sensor inputs 46 indicate that the pressure in the turn bladder 14, 16 is higher than desired, the controller 44 operates the pneumatic control system 20 to decrease the turn bladder 14, 16 pressure.

If, at any time, the controller 44 determines that the deflation of a turn bladder 14, 16 is desired, then controller 44 enters a third mode of operation. In the third mode of operation, the controller 44 operates the pneumatic control system 20 to deflate the inflated turn bladder 14, 16. Further in the third mode, the controller 44 determines from user inputs 46 if the microclimate function is desired. If microclimate function is desired, the controller 44 operates the pneumatic control system 20 to turn on the microclimate device 18.

In the first mode of operation, controller 44 moves the first turn valve 30 to a closed position and second turn valve 28 to a first position, pneumatically coupling the second air source 24 to the microclimate device 18. Additionally, the first air source 22, vent valve 32, and support bladder valves 34, 36, 38, 40 are signaled by the controller 44 to increase, decrease, or maintain pressure in main support bladders 12. Pressure may be increased in support bladder 12 by turning on first air source 22, closing vent valve 32, and opening at least one support bladder valve 34, 36, 38, 40. Pressure may be decreased in support bladder 12 by opening vent valve 32 and opening at least one support bladder valve 34, 36, 38, 40. First air source 22 may also be turned off while pressure is decreased in support bladder 12 or air source 22 may be turned on to lower the rate of pressure decrease in support bladder 12. Controller 44 may maintain pressure in support bladder 12 by closing all of the support bladder valves 34, 36, 38, 40. Each support bladder valve 34, 36, 38, 40 may be coupled to an individual bladder or set of bladders within a zone of the main support and operated individually thus allowing different pressures to be achieved in each corresponding bladder or in each corresponding zone. Further in the first mode of operation, the second air source 24 functions to provide air to the microclimate device 18. Controller 44 may turn on second air source 24 to force air through the microclimate device 18 or turn the second air source 24 off if the microclimate function is not desired.

In the second mode of operation, inflation of one of the turn bladders 14, 16 is desired and both the first air source 22 and the second air source 24 are used at the same time to inflate a turn bladder 14, 16. The first turn valve 30 is moved to an open position pneumatically coupling the first air source 22 with the turn direction valve 42. Additionally, support bladder valves 34, 36, 38, 40 are moved to the closed positions in order to maintain the pressure in main support bladders 12. Further, during inflation of turn bladder 14, 16, the second turn valve 28 is moved to the second position pneumatically coupling the second air source 24 to turn direction valve 42. This arrangement of second turn valve 28 stops the flow of air to the microclimate device 18. If the pressure in the desired turn bladder 14, 16 is less than that in a fully-inflated bladder, the vent valve 32 is moved to a closed position. If the pressure in the desired bladder 14, 16 is greater than that in a fully-inflated bladder, controller 44 may open vent valve 32. If the pressure is greater than a fully-inflated turn bladder, controller 44 may also turn off any combination of first air source 22 and second air source 24. In the second mode of operation, controller 44 operates the turn direction valve 42 to determine which of the left turn bladder 14 or right turn bladder 16 will be inflated. In FIG. 1, the second mode of operation is shown with the turn direction valve 42 in the first position pneumatically coupling the left turn bladder 14 with the first air source 22 and the second air source 24 for inflation.

In the third mode of operation, deflation of one of the turn bladders 14, 16 is desired and the vent valve 32 is used to vent the inflated turn bladder 14, 16. The controller 44 opens the first turn valve 30 and vent valve 32 pneumatically coupling the turn direction valve to the atmosphere. The controller also moves the turn direction valve 42 into a first or second position, whichever corresponds with the turn bladder 14, 16 to be deflated. Thus the turn bladder 14, 16 to be deflated is pneumatically coupled to the atmosphere for deflation. The main support bladder valves 34, 36, 38, 40 are closed in order to maintain the pressure in the support bladder 18 during deflation of the turn bladder 14, 16. First and second air sources 22, 24 are turned off while pressure is decreased in the turn bladder 14, 16. If controller 44 determines that the microclimate function is desired during bladder deflation, second turn valve 28 is signaled by the controller 44 to move to the first position pneumatically coupling second air source 24 with microclimate device 18 and the controller 44 turns on second air source 24. Moving second turn valve 28 to the first position may also allow deflation of the inflated turn bladder 14, 16 through the second turn valve 28.

Figure 2:
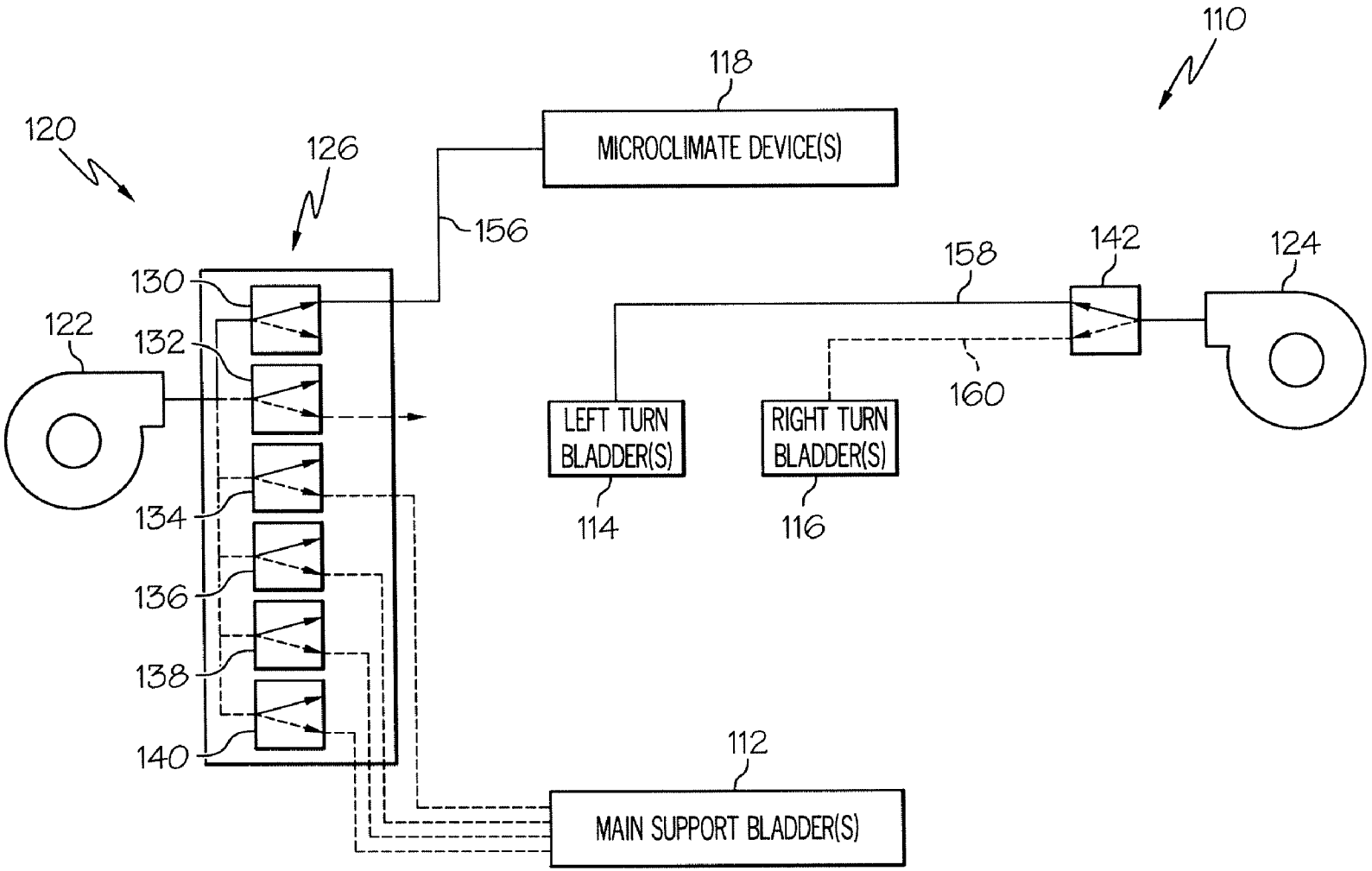
FIG. 2 is a block diagram of a second embodiment of a person support apparatus according to this disclosure, showing the patient support apparatus having an air source that is dedicated to inflating at least one turn bladder and another air source that is used to provide air to at least one microclimate bladder and to at least one main support bladder.

FIG. 2 is a diagrammatic view of an alternative embodiment wherein the first air source 122 provides pressurized air for the main support bladder 12 and the microclimate device 18; while, the second air source 124 provides pressurized air for the left and right turn bladders 14, 16. This configuration differs from the embodiment of FIG. 1 in that the second air source 124 is the only source of pressurized air for inflation of turn bladders 14, 16. Structurally, the first turn valve 30 is replaced with microclimate valve 130 and the second turn valve 28 is eliminated. In the second embodiment, microclimate valve 130 pneumatically couples the first air source 122 with the microclimate device 118 via conduit 156. Also, turn direction valve 142 moves between a first position where the second air source 124 is pneumatically coupled to left turn bladder 114 via conduit 158 and a second position where the second air source 124 is pneumatically coupled to right turn bladder 116 via conduit 160.

In operation, the arrangement of FIG. 2 allows the microclimate device 118 to be used while a turn bladder 114, 116 is inflated or deflated. Also, during turn bladder 114, 116 inflation or deflation, the pressures in main support bladder 112 can be modified without interruption of the inflation or deflation of turn bladders 114, 116. Thus the three modes described in the first embodiment are modified by the alternative arrangement of FIG. 2. However, as in the first embodiment, the controller 44 may, based on user inputs, engage in any of the three modified modes at any time during operation of the alternative embodiment. For example, the second and third modes may be alternated, inflating and deflating turn bladders 114, 116 in sequence to produce continuous lateral rotation therapy.

Thus, in the first "standard support" mode of FIG. 2, the first air source 122 is turned on and provides air as desired to both the main support bladders 112 and microclimate device 118. The second air source 124 is turned off. In the second "turn assist" mode, the second air source 124 is turned on and the turn direction valve 142 is moved in order to effect inflation of one of the turn bladders 114, 116. During the inflation of one of the turn bladders 114, 116, the first air source 122 may continue to provide air to the main support bladder 112 and the microclimate device 118. In the third "return" mode, the turn direction valve 142 moves to allow the inflated turn bladder 114, 116 to deflate through the valve 142. The second air source 124 may be turned off. Also, the first air source 122 may continue to provide air to the main support bladder 112 and the microclimate device 118.

Although the apparatus and operation of the patient support apparatus 10 has been described in detail with reference to a certain illustrative embodiment, variations and modifications exist within the scope and spirit of this disclosure as described and defined in the following claims.

The invention claimed is:

1. A person support apparatus for supporting a person, the person support apparatus comprising a set of air bladders that are inflatable to support the person, the set of air bladders including a first air bladder and a second air bladder, at least one turn bladder that is inflatable to turn the person toward one of the person's sides, and a control system having a first air source and a second air source, the control system having a first mode of operation in which the first air source provides air to the first air bladder and the second air source provides air to the second air bladder, the control system having a second mode of operation in which the first and second air sources both provide air to the at least one turn bladder.

2. The person support apparatus of claim 1, wherein the second air bladder is situated above the first air bladder.

3. The person support apparatus of claim 2, wherein the at least one turn bladder is situated between the first air bladder and the second air bladder.

4. The person support apparatus of claim 2, wherein the at least one turn bladder is situated beneath the first air bladder.

5. The person support apparatus of claim 1, wherein the second air bladder comprises a microclimate control bladder having a low air loss feature.

6. The person support apparatus of claim 1, wherein the control system comprises a first valve coupled to the first air source and a second valve coupled to the second air source, the first valve having a first position in which air from the first air source is fed to the first air bladder and a second position in which air from the first air source is fed to the at least one turn bladder, and the second valve have having a third position in which air is fed from the second air source to the second air bladder and a fourth position in which air from the second air source is fed to the at least one turn bladder.

7. The person support apparatus of claim 6, wherein the control system further comprises a third valve, wherein the at least one turn bladder comprises a right turn bladder and a left turn bladder, the third valve having a fifth position in which air received by the third valve from the first and second air sources is fed to the right turn bladder, and the third valve having a sixth position in which air received by the third valve from the first and second air sources is fed to the left turn bladder.

8. The person support apparatus of claim 1, wherein the first air bladder comprises a plurality of air bladders.

9. The person support apparatus of claim 1, wherein the second air bladder comprises a plurality of air bladders.

10. The person support apparatus of claim 1, wherein the first and second air sources each comprise at least one of a pump, a compressor, or a blower.

11. The person support apparatus of claim 1, wherein the at least one turn bladder comprises a left turn assist bladder and right turn assist bladder and wherein the control system is operable to inflate a designated one of the left turn and right turn bladders to an inflated condition for a predetermined period of time, on a one-time basis, in response to a user activation of a turn assist feature of the control system.

12. The person support apparatus of claim 1, wherein the at least one turn bladder comprises a left rotation bladder and right rotation bladder and wherein the control system is operable to repeatedly and alternately inflate and deflate the left turn and right turn bladders in response to a user activation of a continuous lateral rotation therapy feature of the control system.

13. A person support apparatus for supporting a person, the person support apparatus comprising a set of air bladders that are inflatable to support the person, the set of air bladders including a first air bladder and a second air bladder, at least one turn bladder that is inflatable to turn the person toward one of the person's sides, and a control system having a first air source and a second air source, the control system having a first valve that is moveable between a first position in which air from the first air source is fed to the first bladder and a second position in which air from the first air source is fed to the second bladder, the second air source being coupled to the at least one turn bladder, the second air source having an off state in which the at least one turn bladder is deflated, and the second air source having an on state to inflate the at least one turn bladder.

14. The person support apparatus of claim 13, wherein the second air bladder is situated above the first air bladder.

15. The person support apparatus of claim 14, wherein the at least one turn bladder is situated between the first air bladder and the second air bladder.

16. The person support apparatus of claim 14, wherein the at least one turn bladder is situated beneath the first air bladder.

17. The person support apparatus of claim 13, wherein the second air bladder comprises a microclimate control bladder having a low air loss feature.

18. The person support apparatus of claim 13, wherein the at least one turn bladder comprises a right turn bladder and a left turn bladder and wherein the control system comprises a second valve coupled to the second air source, the second valve having a third position in which air is fed from the second air source to the right turn bladder when the second air source is in the on state and a fourth position in which air from the second air source is fed to the left turn bladder when the second air source is in the on state.

19. The person support apparatus of claim 13, wherein at least one of the first air bladder or the second air bladder comprises a plurality of air bladders.

20. The person support apparatus of claim 13, wherein the first and second air sources each comprise at least one of a pump, a compressor, or a blower.

* * * * *